US007188811B2

(12) United States Patent
Liviero

(10) Patent No.: US 7,188,811 B2
(45) Date of Patent: Mar. 13, 2007

(54) METHOD FOR FORMING BASES FOR ROTATABLE OFFICE CHAIRS AND BASE OBTAINED BY THE METHOD

(75) Inventor: Stefano Liviero, Rossano Veneto (IT)

(73) Assignee: Imarc S.p.A., Rossano Veneto (IT)

( * ) Notice: Subject to any disclaimer, the term of this patent is extended or adjusted under 35 U.S.C. 154(b) by 0 days.

(21) Appl. No.: 10/500,462

(22) PCT Filed: Jan. 17, 2003

(86) PCT No.: PCT/EP03/00442

§ 371 (c)(1),
(2), (4) Date: Jul. 14, 2004

(87) PCT Pub. No.: WO03/061433

PCT Pub. Date: Jul. 31, 2003

(65) Prior Publication Data

US 2005/0012001 A1 Jan. 20, 2005

(30) Foreign Application Priority Data

Jan. 24, 2002 (IT) ..... VE2002A0005

(51) Int. Cl.
*A47B 91/00* (2006.01)

(52) U.S. Cl. ..... 248/188.7; 248/903; 297/452.5

(58) Field of Classification Search ..... 248/188.7, 248/188, 188.1, 188.8, 903; 297/344.1, 440.1, 297/440.24, 452.2, 463.1, 463.2
See application file for complete search history.

(56) References Cited

U.S. PATENT DOCUMENTS

| | | | | |
|---|---|---|---|---|
| 4,799,735 | A | 1/1989 | Meyer | |
| 5,332,188 | A * | 7/1994 | Davis et al. | 248/674 |
| 5,402,973 | A | 4/1995 | Haines | |
| 5,906,343 | A * | 5/1999 | Battey et al. | 248/188.7 |
| 6,290,191 | B1 * | 9/2001 | Hendricks et al. | 248/188.1 |

FOREIGN PATENT DOCUMENTS

| | | | |
|---|---|---|---|
| EP | 171564 | * | 6/1985 |
| EP | 0 517 206 | | 12/1992 |
| GB | 2 081 085 | | 2/1982 |

* cited by examiner

*Primary Examiner*—Ramon O Ramirez
(74) *Attorney, Agent, or Firm*—Hoffman, Wasson & Gitler, P.C.

(57) ABSTRACT

A method for forming rotatable bases for offices chairs characterised by structurally joining together at least two half-shells to form overall a plurality of spokes, each consisting of an elongated box-shaped body, and a central ring into which a column is inserted.

12 Claims, 2 Drawing Sheets

METHOD FOR FORMING BASES FOR ROTATABLE OFFICE CHAIRS AND BASE OBTAINED BY THE METHOD

FIELD OF THE INVENTION

This invention relates to a method for forming bases for rotatable office chairs and a base obtained by the method.

BACKGROUND OF THE INVENTION

Office chairs are known comprising a spoke-type base with feet or wheels and a column mounted on said base and provided with a spring, generally in the form of a gas piston, to adjust the height of the sitting plane from the floor.

A known type of such a base is obtained in one injection moulding step from thermoplastic materials, and presents a substantially U-shaped open cross-section to enable the male die punch to be extracted.

The current regulations regarding safety and reliability tests for chairs require that the base be subjected to a series of verification tests (compressions) to verify their structural strength and the absence of permanent deformations which could prejudice their integrity.

The load conditions to which a single base spoke is subjected can be schematically represented by likening the spoke to a beam fixed at one end to the central core and stressed by a vertical force acting upwards from below and applied at the point to which the wheel or foot is connected. This beam is therefore subjected to straight flexure with its lower fibres subjected to tension and its upper fibres to compression, and presents its maximum bending moment in correspondence with its fixed end, i.e. where the spoke joins the central core.

The base spokes are also subjected to twisting due to the misalignment between the wheel and the pin connecting the wheel to the base.

In those bases constructed in accordance with the known art the spokes are formed with an inverted U profile, i.e. with the material-lacking region lying precisely where the fibres are subjected to high tension forces.

Consequently to resist these stresses, the spokes are reinforced by increasing their thickness, adding reinforcement elements and inserting structural metal parts, or by using materials with better mechanical characteristics.

However all these additions result in considerable increases in material and manufacturing costs.

An object of the invention is to eliminate these drawbacks by providing a chair base presenting high resistance to the stresses concerned.

Another object of the invention is to provide a base which enables the price/performance trade-off to be shifted to a level not attainable by current bases present on the market.

These and other objects which will be apparent from the ensuing description are attained according to the invention by a method for forming office chair bases as described in claim 1.

DETAILED DESCRIPTION OF THE INVENITON

Figure 1:
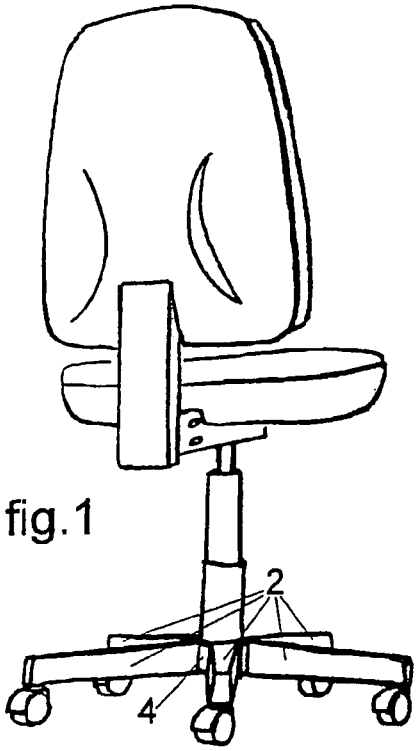
fig.1 PRIOR ART
FIG. 1 shows an example of a chair with base and wheels.
Figure 2:
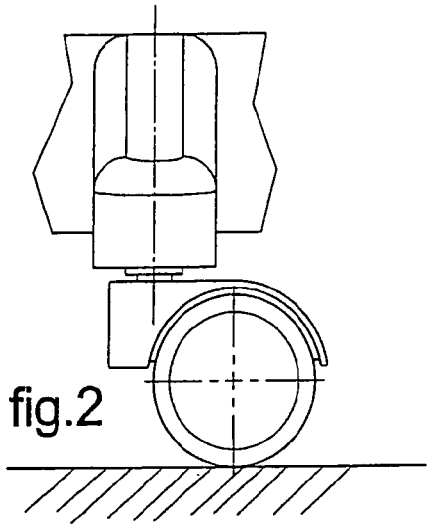
fig.2 PRIOR ART
FIG. 2 shows an enlargement of the base in the wheel connection region.
Figure 3:
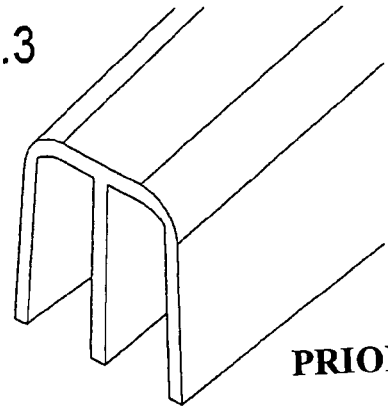
fig.3 PRIOR ART
FIG. 3 is a perspective sectional view of a base spoke of the known art.
Figure 4:
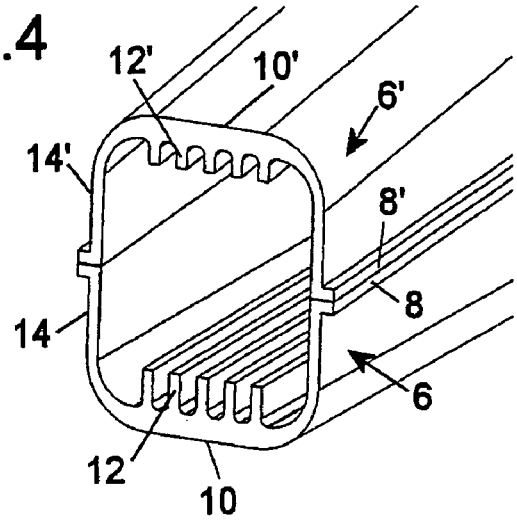
FIG. 4 is a perspective sectional view of a base spoke obtained in accordance with the invention.
Figure 5:
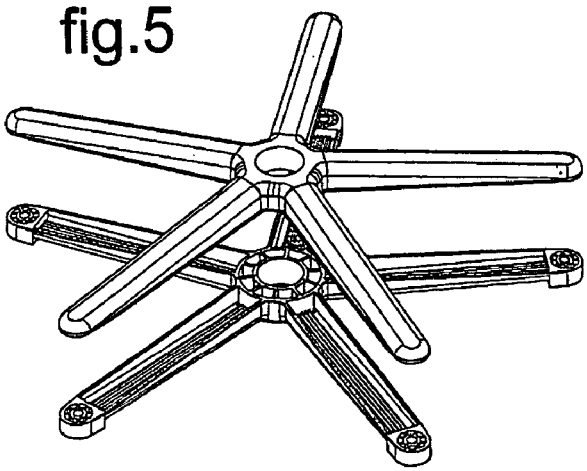
FIG. 5 shows the two half-shells to be assembled.
Figure 6:
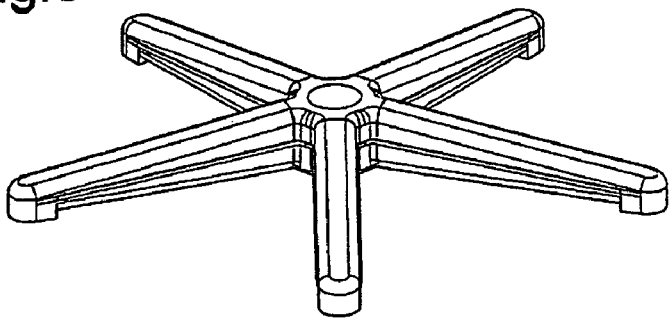
FIG. 6 shows a complete base according to the invention.

As can be seen from the figures the office chair base according to the invention comprises a plurality of spokes 2 extending radially from a central ring 4 into which the column for supporting the seating portion and back-rest is inserted.

The base of the invention is formed by structurally joining together (for example by welding, mechanical coupling, glueing) two plastics concave half-shells hereinafter known as the lower half-shell 6 and the upper half-shell 6'. When joined together, the protrusions of the two half-shells, which are substantially of U cross-section, form spokes of closed cross-section. To facilitate this joining, the two half-shells present longitudinal edges 8, 8' along the joining region. Each spoke has a greater cross-section in the most stressed region, i.e. at its connection to the ring, and a smaller cross-section in the least stressed region, i.e. close to the wheel connection point. In addition, the cross-section presents a preferably vertical extension, with thinner vertical walls 14, 14' and thicker upper and lower transverse walls 10, 10'.

Moreover, both the lower half-shell and the upper half-shell are provided along their horizontal portion 10, 10' with a plurality of stiffening ribs 12, 12'.

All this means that at each cross-section the surface of the vertical portions 14, 14' is much less than the surface of the horizontal portion 10, 10' plus the ribs 12, 12'. This type of cross-section enables distribution of the material to be optimized by increasing its use in the more stressed regions, i.e. within the upper and lower portions, and reducing it within the lateral vertical portions.

To prevent the spokes from undergoing undesirable opening-out during stressing, transverse ribs (not shown in the drawings) are also provided.

The part can be further stiffened by using ribs in the region most distant from the neutral axis and suitably distancing the sides of the upper and lower sections from the neutral axis.

The closed cross-section resulting from joining together the two half-shells also determines a greater resistance to twisting.

From the aforegoing it is apparent that the chair base according to the invention presents the advantage, given its greater strength, of a product with superior mechanical performance for the same material, or for equal performance enables the quantity of material to be reduced, or a material with inferior characteristics to be chosen, with a competitive advantage in terms of cost.

The invention claimed is:

1. A method for forming rotatable bases for offices chairs comprising firmly coupling together at least two half-shells to form a plurality of spokes and a central ring, each spoke comprising an elongated monolithic box-shaped body' forming each spoke with a half shell having a cavity facing another half shell, and inserting a column into said central ring.

2. A method as claimed in claim 1, further comprising joining the two half-shells together by mechanical coupling.

3. A method as claimed in claim 1, further comprising joining the two half-shells together by welding.

4. A method as claimed in claim 1, further comprising joining the two half-shells together by glueing.

5. A method for forming rotatable bases for offices chairs comprising firmly coupling together at least two half-shells to form a plurality of spokes and a central ring, each spoke comprising an elongated monolithic box-shaped body and inserting a column into said central ring further comprising forming each half shell with cavities and forming each spoke by having the cavities of one half-shell facing the cavities of the other half-shell.

6. An office chair base comprising a central ring, a plurality of spokes radially extending along different angles from said central ring, a column inserted into said central ring and supporting a chair seat, wherein each spoke comprises two half-shells firmly coupled to each other to form a monolithic box-shaped body, wherein each spoke is formed by a half shell having a cavity facing another half shell.

7. A base as claimed in claim 6, wherein said spokes are formed of plastic material.

8. A base as claimed in claim 6, wherein for every cross-section, each half-shell has lateral vertical portions and a horizontal portion, the lateral vertical portions having lesser thickness than the thickness of the horizontal portion.

9. A base as claimed in claim 6, wherein each half-shell has ribs which are longitudinal to the axis of the spoke.

10. A base as claimed in claim 6, wherein each spoke has a center and a wheel connection point, each spoke having a cross-section which narrows from the center to the wheel connection point.

11. A base as claimed in claim 6, wherein the two half-shells have a projecting edge extending along their entire length.

12. An office chair base comprising a central ring, a plurality of spokes radially extending along different angles from said central ring, a column inserted into said central ring and supporting a chair seat, wherein each spoke comprises two half-shells firmly coupled to each other to form a monolithic box-shaped body, wherein each half-shell is substantially U-shaped with the cavities of one half-shell facing the cavities of the other half-shell.

* * * * *